US007048406B1

(12) United States Patent
Shih

(10) Patent No.: US 7,048,406 B1
(45) Date of Patent: May 23, 2006

(54) MIRROR DEVICE HAVING AUTOMATIC LIGHT DEVICE

(76) Inventor: Sen Tien Shih, No. 773, Jangtsao Road, Changhua (TW) 500

( * ) Notice: Subject to any disclaimer, the term of this patent is extended or adjusted under 35 U.S.C. 154(b) by 0 days.

(21) Appl. No.: 10/744,471

(22) Filed: Dec. 22, 2003

(51) Int. Cl.
*F21V 33/00* (2006.01)
*A47B 23/06* (2006.01)

(52) U.S. Cl. ..... 362/135; 362/137; 362/276; 362/802

(58) Field of Classification Search ..... 362/128, 362/135, 129, 492, 494, 137, 142, 143, 276, 362/802, 134, 251, 642
See application file for complete search history.

(56) References Cited

U.S. PATENT DOCUMENTS 5,657,563 A * 8/1997 Lane ..... 40/219
5,930,060 A 7/1999 Shih ..... 359/872
6,082,894 A * 7/2000 Batko et al. ..... 374/142
6,273,585 B1 * 8/2001 Wu ..... 362/135

* cited by examiner

*Primary Examiner*—John Anthony Ward
*Assistant Examiner*—Guiyoung Lee
(74) *Attorney, Agent, or Firm*—Charles E. Baxley

(57) ABSTRACT

A mirror device includes one or more light devices disposed behind a mirror, to generate lights to light the mirror. A remote detecting device may be used to detect whether one or more users go toward or go close to the mirror or not, and to actuate the light device to generate the lights when the users are detected to go toward the mirror. The light device may thus be actuated to light the mirror without being contacted by the users or without being operated by the users manually. A control device may be used to actuate the light device to generate the light. The remote detecting device includes a light emitting device to generate a light to detect whether the user goes toward the mirror or not.

1 Claim, 4 Drawing Sheets

MIRROR DEVICE HAVING AUTOMATIC LIGHT DEVICE

BACKGROUND OF THE INVENTION

1. Field of the Invention

The present invention relates to a mirror device, and more particularly to a mirror device having an automatic light device to generate light and to light the mirror device automatically when users move toward the mirror device.

2. Description of the Prior Art

Typical mirror devices have no lights provided therein, such that a separate light device is required to be provided for lighting the mirror device.

In order to solve the problem, the present applicant has developed a mirror device having a contact switch disposed therein, to actuate a light device to light the mirror device when the mirror device is contacted by the users.

For example, U.S. Pat. No. 5,930,060 to Shih discloses the typical mirror device having a light device actuatable or operatable by a contact switch, in order to generate lights to light the mirror device when the mirror device is contacted by the users.

However, the light device may not be automatically actuated or operated to generate the lights to light the mirror device, and is required to be actuated or operated with the contact switch, by contacting the mirror device.

The present invention has arisen to mitigate and/or obviate the afore-described disadvantages of the conventional mirror devices.

SUMMARY OF THE INVENTION

The primary objective of the present invention is to provide a mirror device including an automatic light device to generate light and to light the mirror device automatically when users move toward the mirror device, without being contacted by the users.

In accordance with one aspect of the invention, there is provided a mirror device comprising a mirror, at least one light device disposed behind the mirror, to generate light to light the mirror, and a remote detecting device for detecting whether a user goes toward the mirror or not, and to actuate the light device to generate the light when the user has been detected to go toward the mirror. The light device may thus be actuated to light the mirror without being contacted by the users or without being operated by the users manually.

A control device may further be provided and coupled between the remote detecting device and the light device, to actuate the light device to generate the light. A stabilizer may further be provided and coupled between the control device to supply a stabilized electric power to the light device.

The remote detecting device includes a light emitting device to generate a light and to detect whether the user goes toward the mirror. The light emitting device is preferably an infrared light emitting device.

The remote detecting device includes one or more indicating light members to indicate a working of the light emitting device. The remote detecting device may further include one or more indicating light members to indicate a power supply to the remote detecting device.

A frame may further be provided to support the mirror. A housing may further be provided and attached to the frame, to support the light device and the remote detecting device.

The housing includes a casing provided therein to support the remote detecting device. The casing includes an orifice formed therein, and a lens received in the casing to block the orifice of the casing. A base may further be provided to support the frame.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
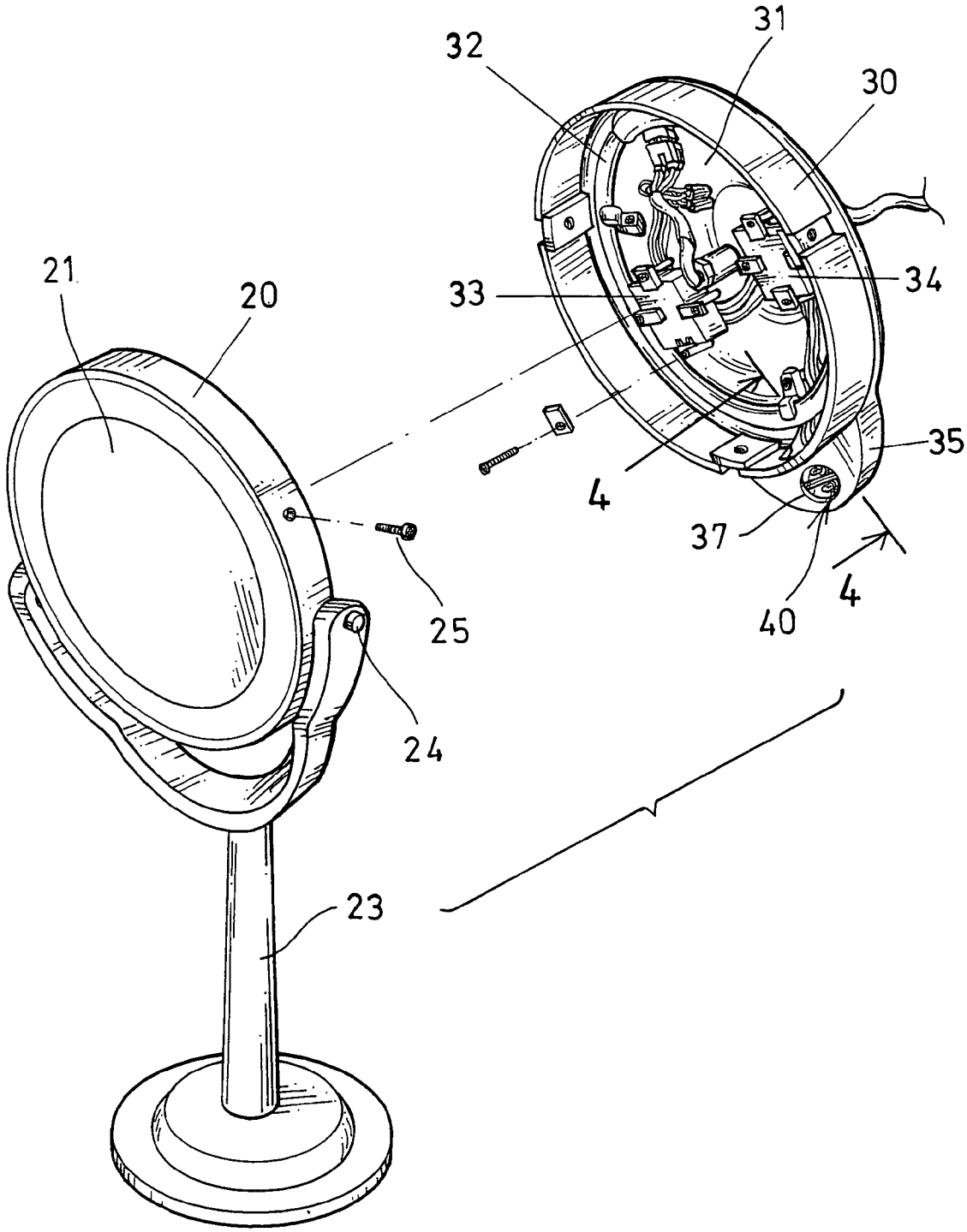
FIG. 1 is a partial exploded view of a mirror device in accordance with the present invention.
Figure 2:
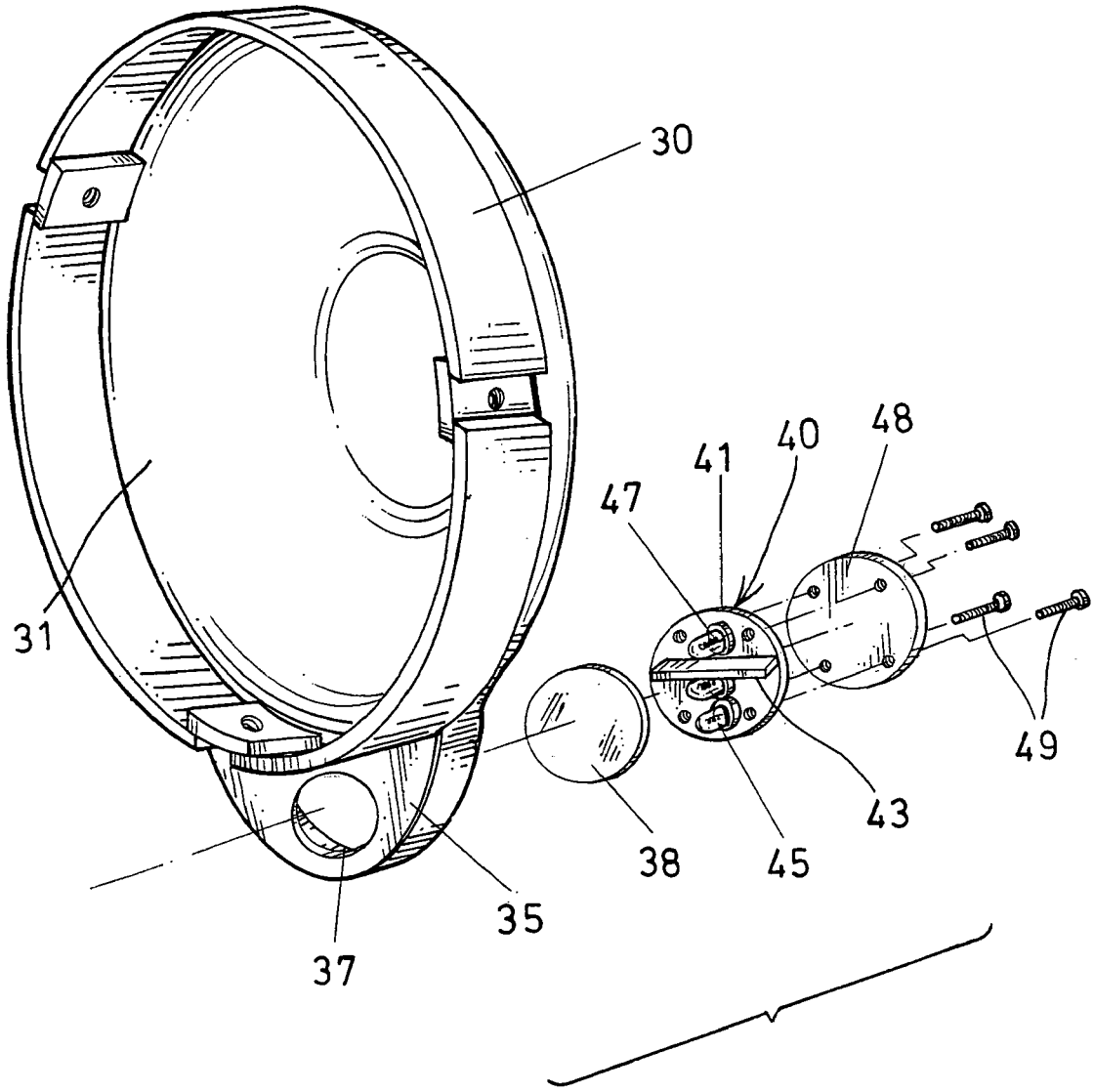
FIG. 2 is another partial exploded view of the mirror device.
Figure 3:
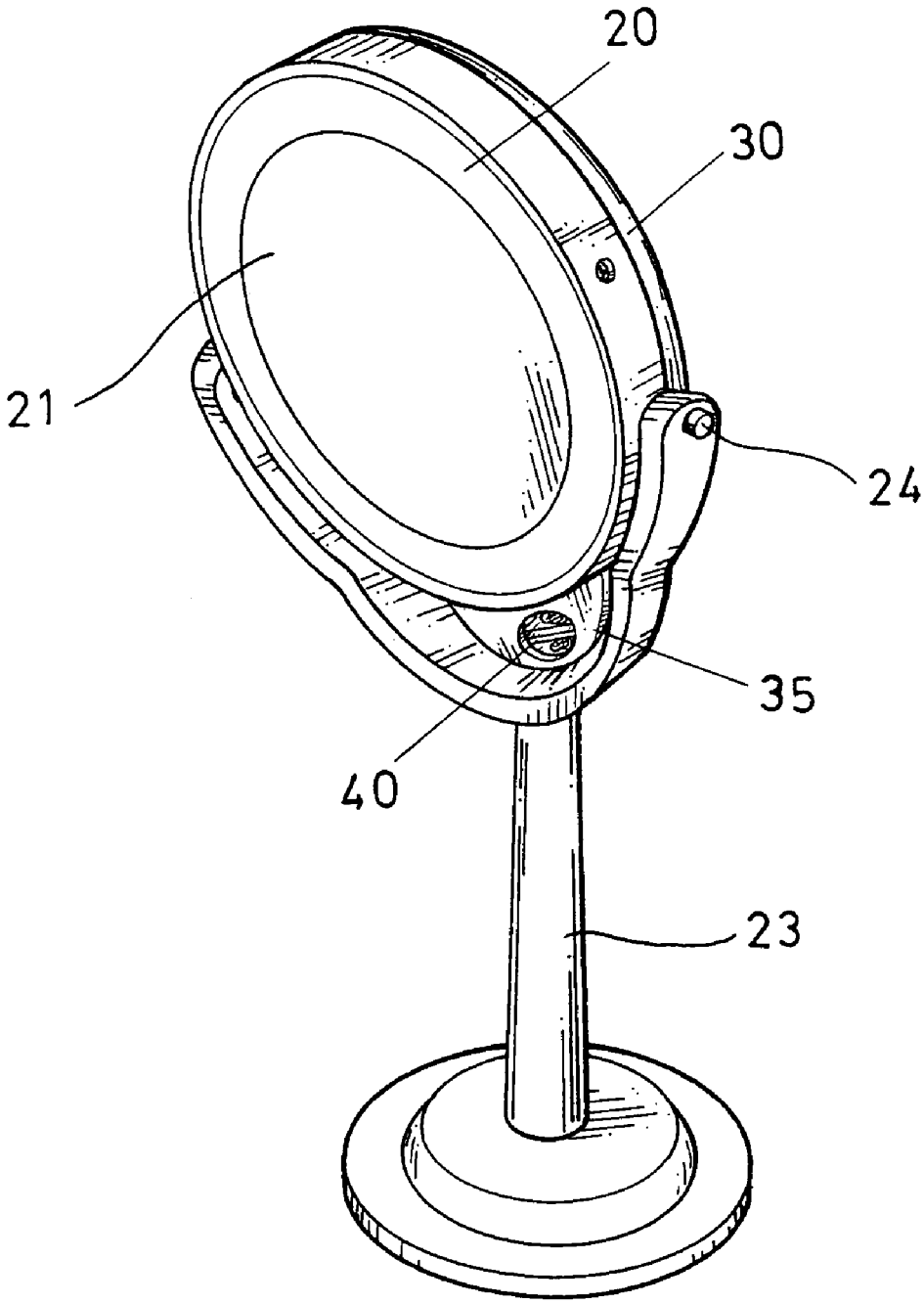
FIG. 3 is a perspective view of the mirror device.

Referring to the drawings, and initially to FIGS. 1–3, a mirror device in accordance with the present invention comprises a frame 20 for engaging with and for supporting a mirror 21 of such as plastic, glass, metal or other materials. The frame 20 is pivotally coupled to and supported on a base 23 with such as a pivot shaft 24.

A housing 30 is secured to the rear portion of the frame 20 with such as fasteners 25, and disposed behind the mirror 21, and includes a chamber 31 formed therein. One or more light devices 32, such as light tubes, light bulbs, light emitting diodes, liquid crystal display, or other illuminate devices are disposed in the chamber 31 of the housing 30, for generating light to light the mirror 21.

Figure 5:
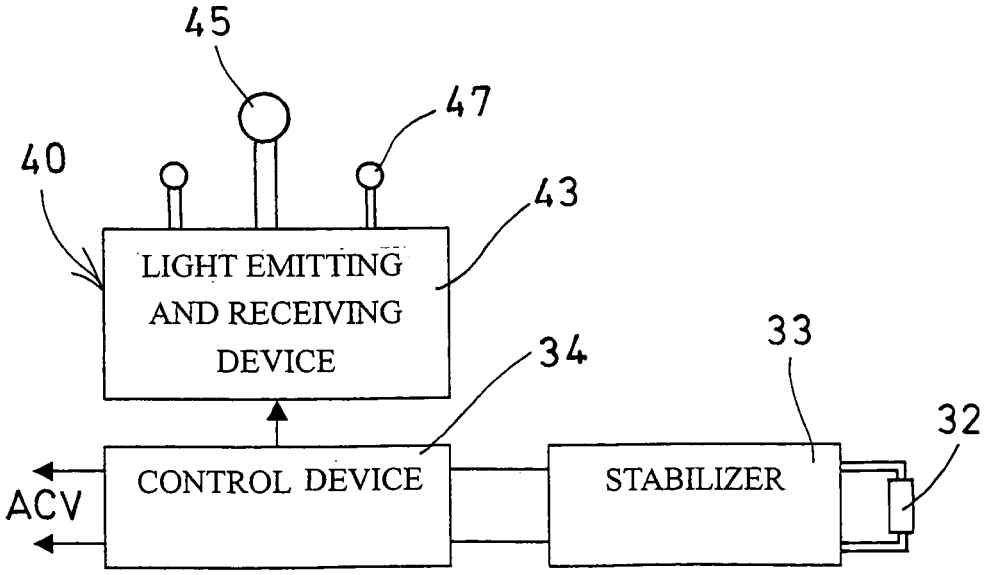
FIG. 5 is a block diagram illustrating the coupling of some of the parts or elements of the mirror device.

A stabilizer 33, and a control device 34, such as a processor device 34, are also disposed in the chamber 31 of the housing 30, and coupled to the light devices 32 (FIG. 5), to control or to actuate the light devices 32 to generate light. The stabilizer 33 may be used to provide or to supply a stabilized electric power to the light devices 32.

Figure 4:
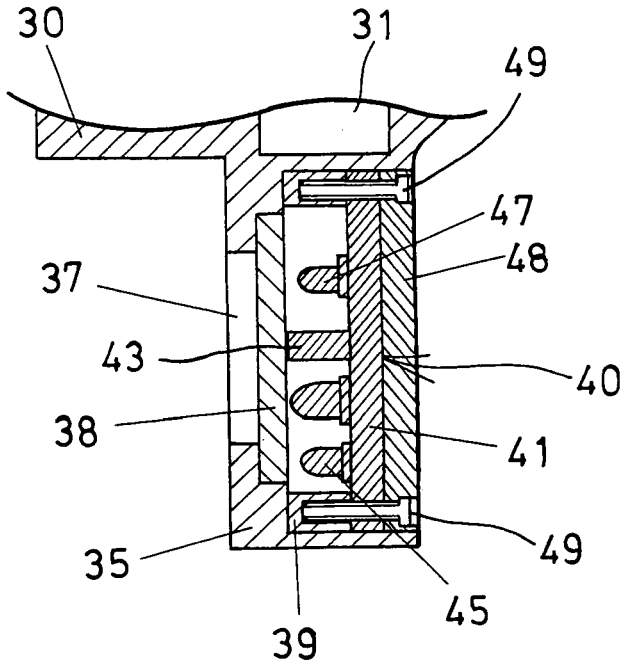
FIG. 4 is a partial cross sectional view of the mirror device, taken along lines 4—4 of FIG. 1.

The housing 30 further includes an orifice 37 formed therein, such as formed in a casing 35 that is extended from the housing 30, and a glass or transparent or semi-transparent lens 38 disposed in the casing 35 to cover or shield the orifice 37 of the casing 35 or of the housing 30. The housing 30 includes one or more, such as four pins 39 (FIG. 4) extended in the casing 35, for example.

A remote detecting device 40 is further provided and includes a circuit board 41 disposed in the casing 35, and includes a light emitting module or device 43, such as an infrared light emitting device 43 or an infrared light emitting and/or receiving device 43 for generating infrared rays, to detect whether one or more users are going toward or close to the mirror 21 or not.

The remote detecting device 40 further includes one or more indicating light members 45 attached to the circuit board 41, to indicate whether an electric power energy has been supplied to the remote detecting device 40 or not, and one or more further indicating light members 47 attached to the circuit board 41, to indicate whether the light emitting and receiving device 43 is working or not.

A cap 48 may be engaged onto the circuit board 41, and/or engaged onto the casing 35, and secured to the casing 35 with such as fasteners 49, to stably retain the lens 38 and the circuit board 41, and the light emitting and receiving device 43, and the indicating light members 45, 47 in the casing 35 or in the housing 30.

In operation, the light emitting and receiving device 43 may generate lights, such as infrared rays out through the lens 38 or the orifice 37 of the casing 35 or of the housing 30, to detect whether one or more users are going toward or close to the mirror 21 or not.

When light emitting and receiving device 43 has detected that one or more users are going toward or close to the mirror 21, the control device 34 may control or actuate the light devices 32 to generate light and to light the mirror 21, such that the light devices 32 may be actuated or operated automatically without being actuated by the users manually.

Accordingly, the mirror device in accordance with the present invention includes an automatic light device to generate light and to light the mirror device automatically when users move toward the mirror device, without being contacted by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mirror device comprising:

a base, a frame pivotally coupled to said base, a mirror attached to said frame, a housing attached to said frame, and disposed behind said mirror, and including a casing provided therein, said casing including an orifice formed therein, a lens received in said casing to block said orifice of said casing, at least one light device disposed in said housing, and disposed behind said mirror, to generate light to light said mirror, a remote detecting device disposed in said casing of said housing, including an infrared light emitting device to generate a light through said lens and said orifice of said casing, for detecting whether a user goes toward said mirror or not, and to actuate said at least one light device to generate the light when the user has been detected to go toward said mirror, said remote detecting device including at least one indicating light member to indicate a working of said light emitting device and including at least one indicating light member to indicate a power supply to said remote detecting device, a control device coupled between said remote detecting device and said at least one light device, to actuate said at least one light device to generate the light, and a stabilizer coupled between said control device to supply a stabilized electric power to said at least one light device.

* * * * *